US009375370B2

(12) United States Patent
Horacek

(10) Patent No.: US 9,375,370 B2
(45) Date of Patent: Jun. 28, 2016

(54) FOLDABLE WHEELCHAIR

(71) Applicant: Gregor Horacek, Ransbach-Baumbach (DE)

(72) Inventor: Gregor Horacek, Ransbach-Baumbach (DE)

( * ) Notice: Subject to any disclaimer, the term of this patent is extended or adjusted under 35 U.S.C. 154(b) by 0 days.

(21) Appl. No.: 14/783,984

(22) PCT Filed: Feb. 22, 2014

(86) PCT No.: PCT/EP2014/000472
§ 371 (c)(1),
(2) Date: Oct. 12, 2015

(87) PCT Pub. No.: WO2014/173477
PCT Pub. Date: Oct. 30, 2014

(65) Prior Publication Data

US 2016/0058637 A1 Mar. 3, 2016

(30) Foreign Application Priority Data

Apr. 23, 2013 (EP) ..... 13 164 970

(51) Int. Cl.
*A61G 5/08* (2006.01)
*A61G 5/10* (2006.01)

(52) U.S. Cl.
CPC ..... *A61G 5/08* (2013.01); *A61G 5/1062* (2013.01); *A61G 2005/0825* (2013.01); *A61G 2005/0866* (2013.01); *A61G 2005/0883* (2013.01); *A61G 2005/1054* (2013.01)

(58) Field of Classification Search
CPC . A61G 5/08; A61G 5/062; A61G 2005/0825; A61G 2005/0866; A61G 2005/0883
See application file for complete search history.

(56) References Cited

U.S. PATENT DOCUMENTS 4,682,783 A * 7/1987 Kuschall ..... A61G 5/08 280/250.1
5,188,383 A * 2/1993 Thompson ..... A61G 5/08 280/250.1

(Continued)

FOREIGN PATENT DOCUMENTS

EP 1 913 917 A1 4/2008
FR 2 574 287 A1 6/1986

OTHER PUBLICATIONS

International Bureau of WIPO, International Preliminary Report on Patentability / Written Opinion of the International Searching Authority [PCT/EP2014/000472], Oct. 27, 2015, 5 pages.

*Primary Examiner* — John Walters
*Assistant Examiner* — James Triggs
(74) *Attorney, Agent, or Firm* — Christopher C. Dremann, P.C.; Christopher C. Dremann

(57) ABSTRACT

A foldable wheelchair includes two side frames, each having a front wheel and a rear wheel mounted thereon, and a scissor-type element arranged between the side frames and having two scissor-type arms that are mounted pivotably in the side frames in one scissor-type element end. The scissor-type arms are mounted pivotably in another scissor-type element end in manually actuable actuating members that are mounted pivotably to the side frames at a distance from the pivot axis of the other scissor-type element end. A folding hinge is mounted pivotably in the side frames and is arranged at a distance from the other scissor-type element end. An actuating means is connected pivotably to the folding hinge at a distance from the side frames and is effective between the folding hinge and one of the actuating members at a distance from the pivot axis of the actuating member in the associated side frame. Means are provided for fixing at least one actuating member relative to the associated side frame in the unfolded position of the wheelchair.

15 Claims, 11 Drawing Sheets

(56) References Cited

U.S. PATENT DOCUMENTS 6,164,674 A * 12/2000 Rogers ..... A61G 5/08
280/250.1

6,799,770 B2 * 10/2004 Patrick ..... A61G 5/006
280/250.1

7,055,840 B1 * 6/2006 Kelso ..... A61G 5/10
280/250.1

* cited by examiner

FOLDABLE WHEELCHAIR

CROSS-REFERENCE TO RELATED APPLICATIONS

This United States national stage non-provisional patent application claims priority to International Application No. PCT/EP2014/000472 filed on Feb. 22, 2014, which claims priority to European Patent Application No. EP 13 164 970.9 filed on Apr. 23, 2013, the entire disclosures of which are incorporated herein by reference.

FIELD OF THE INVENTION

The invention relates to a foldable wheelchair having two side frames, in each of which a front wheel and a rear wheel are mounted, and having a scissor-action element, which is arranged between the side frames and has two scissor-action arms, wherein the scissor-action arms, in the region of the one scissor-action element end, are mounted in a pivotable manner in the side frames.

BACKGROUND OF THE INVENTION AND RELATED ART

Such foldable wheelchairs are common knowledge from the prior art, for example from DE 20 2008 009 608 U1. This prior art makes use of a scissor-action element, also referred to as a cross-strut. The pivot axis of the scissor-action arms of the scissor-action element here is arranged parallel to the surface over which the wheels of the wheelchair stand on the ground. Therefore, in the case of the ground being arranged horizontally, the pivot axis common to the two scissor-action arms of the scissor-action element is arranged horizontally. When the wheelchair is folded together, this pivot axis moves upwards, that is to say in a vertical plane. The lower ends of the scissor-action arms are mounted in a rotatable manner on lower horizontal tubes of the side frames. A respective seat tube is welded horizontally onto the upper ends of the scissor-action arms. These horizontally welded-on seat tubes rest, in the opened-out state of the wheelchair, on bearings which are adapted to the seat tubes and are fastened on upper, horizontal tube portions of the seat frames. During the folding operation, the horizontally welded-on seat tubes move freely upwards, while the side frames move towards one another. A respective lug, which is connected in a rotatable manner both to one scissor-action element half and to the corresponding side frame, ensures that the side frames, during the folding operation, are guided parallel to one another and the seat tubes of the scissor-action element are positioned precisely in the bearings.

Also known in practice are the "AVANTGARDE" series of foldable wheelchairs from Otto Bock HealthCare GmbH, D-37115 Duderstadt, the "EASY" series of foldable wheelchairs from Sunrise Medical GmbH & Co. KG, D-69254 Malsch and the "Traveller4you" series of foldable wheelchairs from PROACTIV Reha-Technik GmbH, D-72359 Dotternhausen.

OBJECTS AND SUMMARY OF THE INVENTION

It is an object of the present invention to develop a foldable wheelchair of the type mentioned in the introduction, such that, along with the wheelchair having a high level of strength in the opened-out state, the wheelchair can be folded together widthwise to give compact folding dimensions. The wheelchair should be very straightforward to handle for opening-out and folding-together purposes.

The object is achieved in that the scissor-action arms, in the region of the other scissor-action element end, are mounted in a pivotable manner in manually actuable adjusting members, which are mounted in a pivotable manner in the side frames at a distance from the pivot axis of the other scissor-action element end in the adjusting members, and arranged at a distance from the other scissor-action element end is a folding hinge, which is mounted in a pivotable manner in the side arms, also having an adjusting means, which is connected in a pivotable manner to the folding hinge, at a distance from where the latter is mounted in the side frames, and is active between the folding hinge and one of the adjusting members, at a distance from the pivot axis of said adjusting member in the associated side frames, and also having means by way of which at least one adjusting member is secured, in the opened-out position of the wheelchair, relative to the side frame assigned to said adjusting member.

In the case of the wheelchair according to the invention, the particularly high level of strength of the wheelchair in the opened-out state is achieved on account of the wheelchair being designed both with the scissor-action element and with the folding hinge. The fixed ends of the scissor-action element here are assigned to the side frames and the adjustable ends of the scissor-action element are assigned to the manually actuable adjusting members, which are mounted in a pivotable manner in the side frames. Alteration of the pivoting positions of the manually actuable adjusting members results, when the adjusting members are pivoted in the one direction, in the scissor-action arms of the scissor-action element being spread apart to a greater extent, and thus in the wheelchair being opened out, whereas pivoting of the adjusting members in the opposite direction results in the scissor-action element being closed to a more pronounced extent, the wheelchair thus being folded together. In the defined, opened-out end position, the wheelchair is retained in its extended position by the means for securing the at least one adjusting member relative to the side frame assigned to said adjusting member. It is quite possible for this securing action to be achieved indirectly. Once the at least one adjusting member has been secured, this means that the at least one adjustable end of the scissor-action element and, via the kinematics of the scissor-action element, also the other adjustable end of the scissor-action element are secured, and thus, the side frames are kept at a defined distance apart with the wheelchair in the opened-out state. A particularly high level of strength of the wheelchair in the opened-out state is achieved if, in this position of the wheelchair, the folding hinge assumes a rigid position, as seen in relation to the orientation of the folding hinge relative to the two scissor-action arms. As far as this aspect is concerned, it is considered to be particularly advantageous if the bearing points of the folding hinge in the side frames and the pivot pin formed by the two hinge parts of the folding hinge, in the opened-out position of the wheelchair, are arranged on a straight line.

Designing the wheelchair with the scissor-action element and the folding hinge allows compact or small folding dimensions of the wheelchair in the folded-together state of the wheelchair. In this state, the scissor-action element is largely closed and the legs of the folding hinge more or less butt against one another.

The adjusting means, which is connected in a pivotable manner to the folding hinge, at a distance from where the latter is mounted in the side frames, serves for coupling the movements of the folding hinge and the one manually actuable adjusting member. This coupling may be configured in different ways and may also take effect in different ways, for example in a linear or non-linear manner. It is therefore possible, with an appropriate kinematic design, for the adjusting means to transmit the movement of the adjusting member directly to the folding hinge, both in the movement direction of the folding hinge for transferring the wheelchair into the opened-out position and in the other movement direction, for transferring the wheelchair into its folded-together position. It is also possible here for the adjusting means to be assigned to the adjustable end of the scissor-action element, said adjustable end interacting with the adjusting member. The adjusting means may be designed in the form of a rigid component or quite possibly also as an alterable-length component, the latter configuration being achieved, in particular, in conjunction with spring means which are active between a side frame and the folding hinge and/or a side frame and the adjusting means.

An exemplary embodiment of the invention provides that a bearing rod for a pushing handle, for pushing the wheelchair, is mounted in the respective adjusting member. This bearing rod forms, in particular, a backrest tube for accommodating a backrest covering, thus a tube in the region of the back of the person using the wheelchair. Since it is necessary, for the purpose of transferring the wheelchair from the opened-out state to the folded-together state, for the adjusting members to be actuated manually, this can readily take place, according to the aforementioned development, in that said folding operation is accomplished by virtue of the bearing rod being pivoted as a result of forces being introduced into the pushing handle. Alongside this possibility of transferring the wheelchair from the opened-out state to the folded-together state, and likewise from the folded-together state to the opened-out state, on account of this straightforward movement, it is thus possible for the wheelchair to be converted, when being folded together, into a particularly space-saving arrangement. This is because the bearing rods and the backrest tubes, with the pushing handles, can be pivoted in particular towards the side frames, preferably virtually until the bearing rods butt against the side frames. In the folded-together state, it is thus the case that the extent of the wheelchair is reduced to a minimum not just in the width direction, but also in the height direction.

The respective bearing rod, when the wheelchair is in the opened-out position, is preferably arranged perpendicularly to the plane in which the front wheels and the rear wheels stand on the ground where the wheelchair has been placed and, in the folded-together position of the wheelchair, the bearing rod, in the region of its end which accommodates the pushing handle, is arranged adjacent to the associated side frame.

It is considered to be particularly advantageous if the respective adjusting member, for the purpose of transferring the wheelchair from its opened-out position into its folded-together position, can be pivoted through an angle of about eighty degrees) (80°) to about ninety degrees (90°), and in particular to about ninety degrees (90°). In the case of such a pivoting angle, it is ensured, in particular, that a bearing rod interacting with the respective adjusting member, or a backrest tube, can be transferred, when the wheelchair is in the folded-together state, into the end position directed towards the frame.

The folding hinge can preferably be folded in a plane which is parallel to the plane in which the front wheels and the rear wheels stand on the ground. If the ground is horizontal, this means that the folding hinge can be folded in a horizontal plane. This arrangement of the folding hinge is advantageous, in particular, from points of view relating to space and particularly straightforward attachment of the folding hinge to the adjusting member.

In particular, it is provided that the folding hinge, in the folded-together state, is directed towards the rear axle of the wheelchair, said rear axle being formed by the rear wheels. When the folding hinge is swung together, it is thus directed towards the scissor-action element. This swinging direction can likewise be considered from the point of view of a compact arrangement of the folding hinge and scissor-action element in the wheelchair.

Another exemplary embodiment provides that the one scissor-action element ends and the folding hinge are connected to the side frames in front of the rear axle, which is formed by the rear wheels, and the other scissor-action element ends are mounted in the adjusting members behind the rear axle. This gives rise to points of engagement of the scissor-action element ends, as seen in relation to the front and rear orientation of the wheelchair relative to the wheelchair user, which are positioned fairly far apart, and, in addition, the folding hinge is arranged usually in the front half of the wheelchair.

A particularly advantageous structural configuration of the wheelchair provides that the scissor-action arms of the one scissor-action element end are mounted in first holders such that they can be pivoted about parallel pins, and these holders are mounted in the side frames such that they can be pivoted about a pin arranged perpendicularly to said parallel pins, and the pivoting arms of the other scissor-action element end are mounted in second holders such that they can be pivoted about parallel pins, and these holders are mounted in the adjusting members such that they can be pivoted about a pin arranged perpendicularly to said parallel pins. This configuration gives rise to particularly straightforward attachment of the scissor-action element in relation to the two side frames and the two adjusting members.

From the point of view of optimum space conditions between the scissor-action element and the folding hinge when the wheelchair is folded together and of optimum arrangement of the transverse connections of the wheelchair with a view to strengthening the wheelchair, it is considered to be particularly advantageous if the one scissor-action element ends are mounted in lower regions of the side frames and the adjusting members, which accommodate the other scissor-action element ends, are mounted in the upper regions of the side frames. Accordingly, the axis of the scissor-action element, that is to say the axis of rotation of the two scissor-action arms in relation to one another, is not arranged vertically; rather, it is arranged at an acute angle to the vertical, in particular in a vertical plane.

Another exemplary embodiment provides that the adjusting means, in the region of its end which is directed away from the folding hinge, is mounted in a pivotable manner in one of the adjusting members or is mounted in a pivotable manner in a holder for one of the scissor-action arms, said holder being mounted in the adjusting member. Said end of the adjusting means, when the adjusting member is pivoted, thus moves in accordance with the adjusting member or the holder for the one scissor-action arm.

Against this background, it is considered to be particularly advantageous if the adjusting element is telescopic and has a stop for limiting the contracting movement of the adjusting element when the wheelchair is being opened out. When the adjusting member is pivoted in order to transfer the wheelchair into its opened-out position, the length of the telescopic adjusting element decreases until the stop becomes active and thus the adjusting element, forming a rigid element, transmits the movement of the adjusting member, with positive geometric coupling, to the one arm of the folding hinge, in particular until, with the wheelchair opened out, the folding hinge assumes its straightened-out position. In order to move the folding hinge from said straightened-out position so as to transfer the wheelchair into its folded-together position, means, in particular spring means, are provided, these being active between one of the side frames and one of the hinge parts of the folding hinge. These means subject said hinge part to an adjusting force in order to move the folding hinge in the direction of its folded-together position. Upon movement of the adjusting means in order to fold the wheelchair together, it is indeed the case that the telescopic adjusting element lengthens, since there is no stop present in this movement direction. However, the means ensures that the swing-action hinge is moved out of the straightened-out end position and by virtue of the side frames being moved towards one another, as a result of the scissor-action element acting on the side frames, the folding hinge can be transferred into its folded-together position.

The adjusting members are preferably mounted in a pivotable manner in the region of rear ends of the side frames, and bearing pins of the scissor-action element in the region of the other scissor-action element end are arranged beneath, and behind, bearing pins of the adjusting members in the side frames. This ensures that, on the one hand, the other scissor-action element ends can be mounted in a stable manner with only a low level of play and, on the other hand, the bearing rods or backrest tubes can be positioned, and supported, in a defined manner at the rear ends of the side frames.

It is particularly advantageous if it is possible to alter the bearing points of the folding hinge in the side frames and the bearing points of the scissor-action element ends in the adjusting means, for the purpose of altering the width of the side-frame arrangement formed by the side frames.

The present invention, including the development thereof, thus proposes a wheelchair in which the side frames and the bearing rods or backrest tubes assume compact folding dimensions in one operation by the side frames being moved towards one another and the bearing rods or backrest tubes being capable of being positioned more or less parallel to, and at a small distance from, the side frames.

The design may be such that the wheelchair frame has maximum strength and the seat width of the wheelchair frame can be altered without components being changed over. It is possible for side frames and bearing rods or backrest tubes to be folded simultaneously.

Further features of the invention are will be apparent from the following detailed description of the invention, in the description of the figures and in the figures themselves, and it should be noted that all the individual features, and all combinations of individual features, represent further inventive configurations to be encompassed by the intended broad scope of the invention.

BRIEF DESCRIPTION OF THE DRAWING FIGURES

The accompanying drawing figures illustrate the invention with reference to one or more exemplary embodiments, without being restricted thereto.

DETAILED DESCRIPTION OF EXEMPLARY EMBODIMENTS

Figure 1:
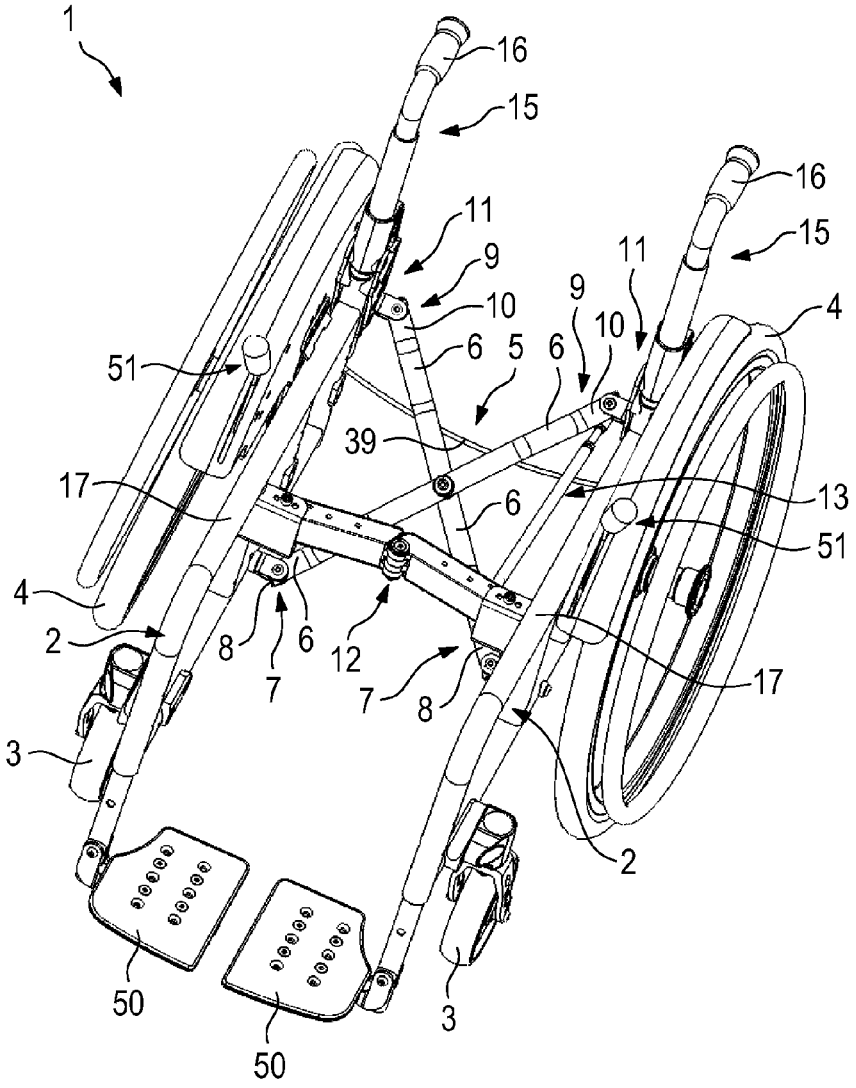
FIG. 1 shows, in a view seen obliquely from the front, the foldable wheelchair in the opened-out state, but depicted without a seat, in particular without a covering for the seat and backrest.
Figure 2:
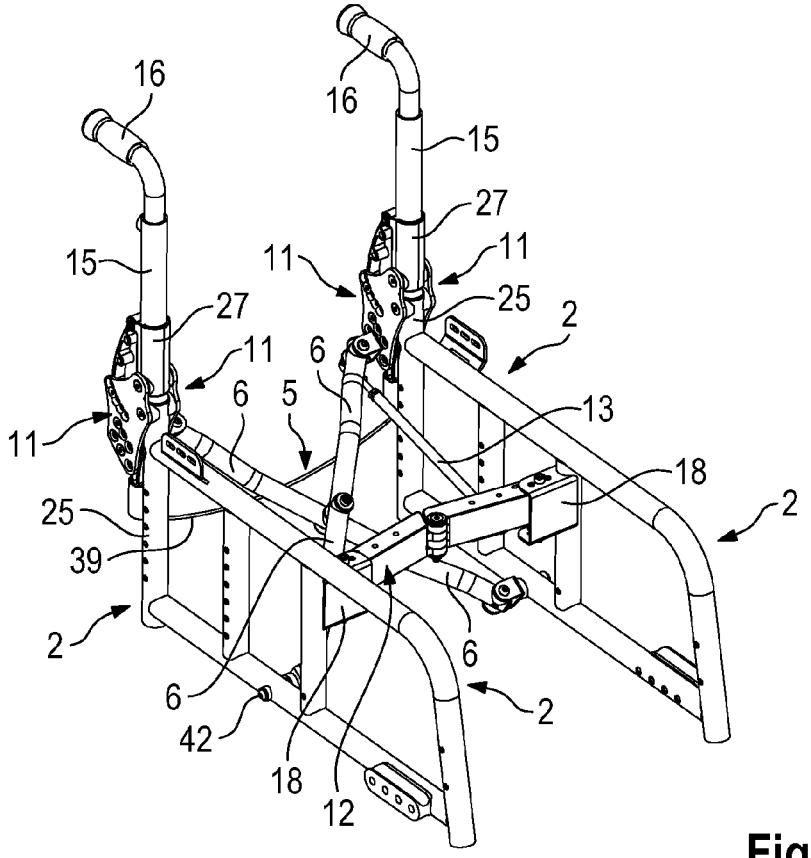
FIG. 2 shows, in a view seen obliquely from the front, the wheelchair depicted in FIG. 1, but, to give a better understanding of the present invention, with the wheels, mudguards, wheel bearings and footrests of the wheelchair not depicted.

FIG. 1 shows a foldable wheelchair 1 without the seat serving to accommodate a person depicted. The terms used hereinbelow relating to front, rear, right(-hand), left(-hand), upwards and beneath/downwards should be understood against the background of the orientation of a person sitting on the wheelchair 1.

Figure 3:
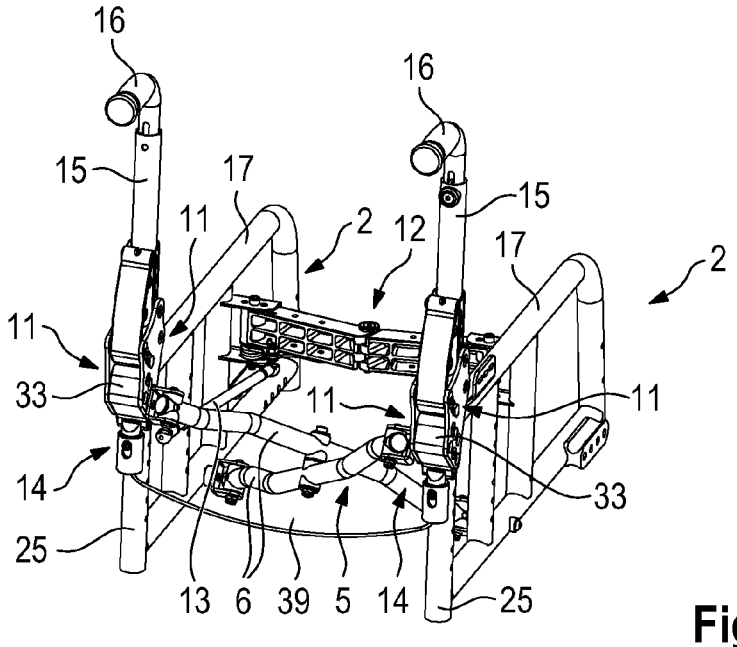
FIG. 3 shows the arrangement according to FIG. 2, as seen obliquely from the rear.

The wheelchair 1 has two parallel side frames 2, in which are mounted in each case a steerable front wheel 3 and a manually drivable rear wheel 4, as well as two footrests 50 and brakes 51 for the rear wheels 4. The side frames 2 have arranged between them a scissor-action element 5, which has two identically designed scissor-action arms 6. The scissor-action arms 6, in the region of one scissor-action element end 7, specifically in the region of the end 8 of the respective scissor-action arm 6, are mounted in a pivotable manner in the side frames 2. The scissor-action arms 6, in the region of the other scissor-action element end 9, specifically the ends 10 of the scissor-action arms 6, are mounted in a pivotable manner in manually actuable adjusting members 11. The latter are mounted in a pivotable manner in the side frames 2 at a distance from the pivot axis of the scissor-action element end 9 in the adjusting members 11. A folding hinge 12 is arranged at a distance from the other scissor-action end 9. The folding hinge 12 is mounted in a pivotable manner in the side frames 2. A telescopic adjusting means 13 is connected in a pivotable manner to the folding hinge 12, at a distance from where the latter is mounted in the side frames 2. The adjusting means 13 is active between the folding hinge 12 and one of the adjusting members 11, at a distance from the pivot axis of said adjusting member 11 in the side frame 2 directed toward the same. By way of means 14 (see FIG. 3), the adjusting members 11 are secured, in the opened-out position of the wheelchair 1, relative to the side frames 2 assigned to said adjusting members.

The wheelchair 1 can be folded in two planes by means of the thus diagonally arranged scissor-action element 5. This means that a single folding movement can both move the two side frames 2 in relation to one another and pivot backrest tubes 15 with integrated pushing handles 16, said backrest tubes being connected to the adjusting members 11, parallel to, and at a small distance from, upper, horizontally arranged tube parts 17 of the side frames 2, reference being made here to the wheelchair 1 in a horizontal state, resting on a horizontal underlying surface or ground. By virtue of the folding hinge 12 being shifted in relation to its rotary bearings on the side frames 2, and by virtue of the scissor-action element 5 being shifted in relation to its rotary bearings on the adjusting members 11 or side frames 2, it is possible to vary the frame width, that is to say the maximum distance between the side frames 2 of the opened-out wheelchair 1. The arrangement of the scissor-action element 5, folding hinge 12 and adjusting means 13 ensures a high level of strength for the wheelchair frame.

Reference will be made hereinbelow to the illustrations of FIGS. 2 to 9, which depict the wheelchair components, or the individual constituent parts thereof, which are essential for carrying out the folding operation of the wheelchair.

Figure 4:
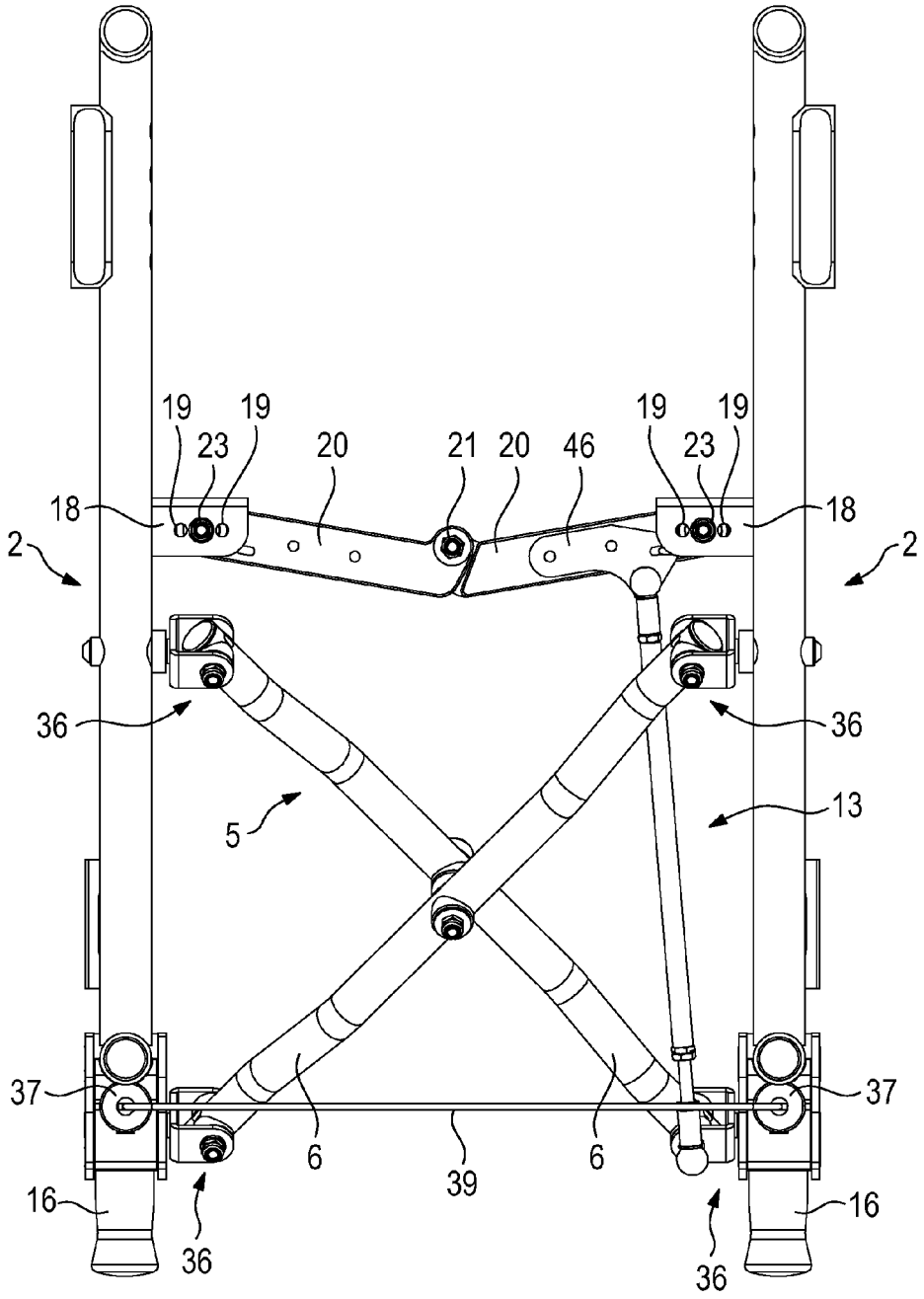
FIG. 4 shows a bottom view of the arrangement according to FIGS. 2 and 3.
Figure 5:
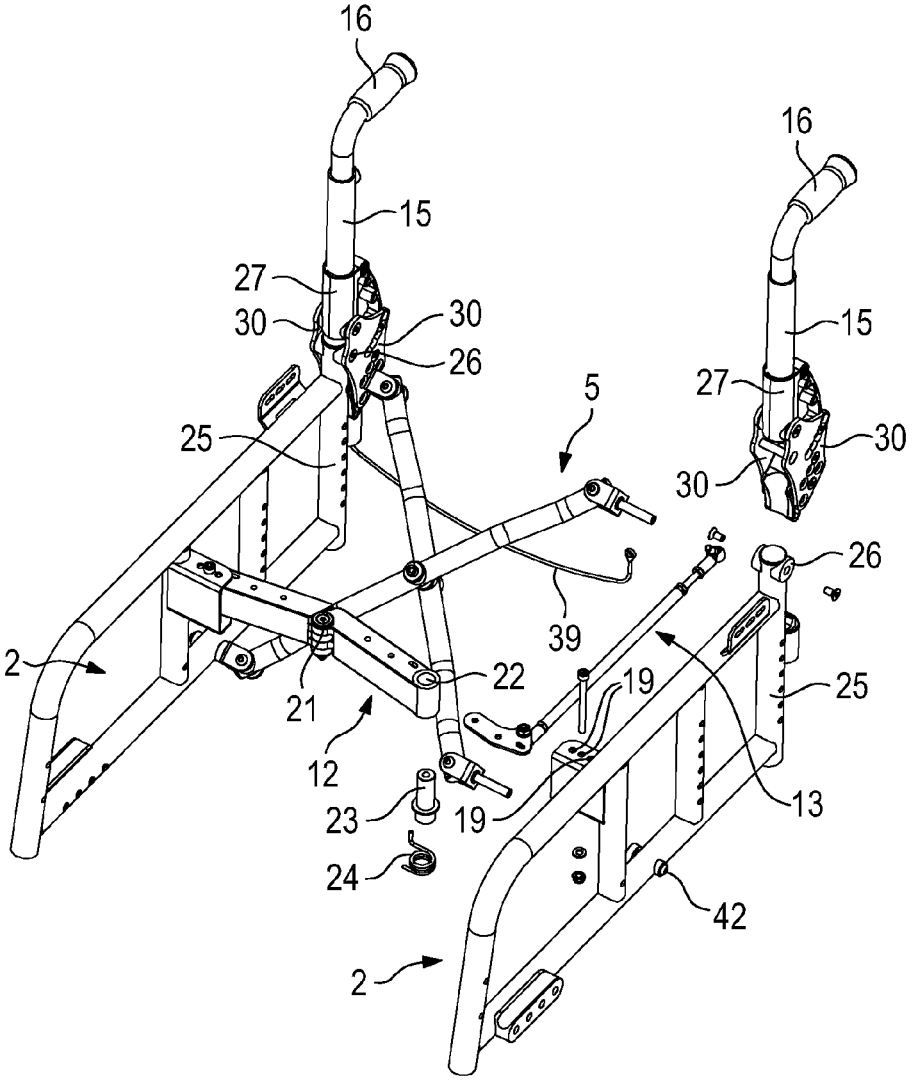
FIG. 5 shows a partially exploded illustration of the arrangement according to FIGS. 2 and 3, as seen obliquely from the front.

As best shown in FIG. 4, the side frames 2, on the left and right, are connected in each case in their front, upper region, at their hinge bearings 18, by the folding hinge 12. The hinge bearings 18 have a plurality of bores 19, for example in each case three bores spaced apart by 10 mm. The folding hinge 12 comprises two identical hinge halves 20, which are connected to one another in a pivotable manner by means of a central hinge pin 21. The outer ends of the hinge halves 20 have bores 22 (FIG. 5) for pivotable mounting hinge bearing pins 23 therein. The hinge bearing pins 23, in turn, are screwed tightly in a respective one of the bores 19 of the hinge bearings 18. By virtue of the hinge bearing pins 23 being shifted, it is possible to alter the seat width, for example by 20 mm, in three stages.

A leg spring 24 (FIG. 5) is mounted at the lower end of one of the hinge bearing pins 23 and acts on the corresponding hinge half 20 so as to initiate, and assist, the folding together of the folding hinge 12. This is only an exemplary solution for providing spring force, which may be realized in a variety of other ways.

Figure 6:
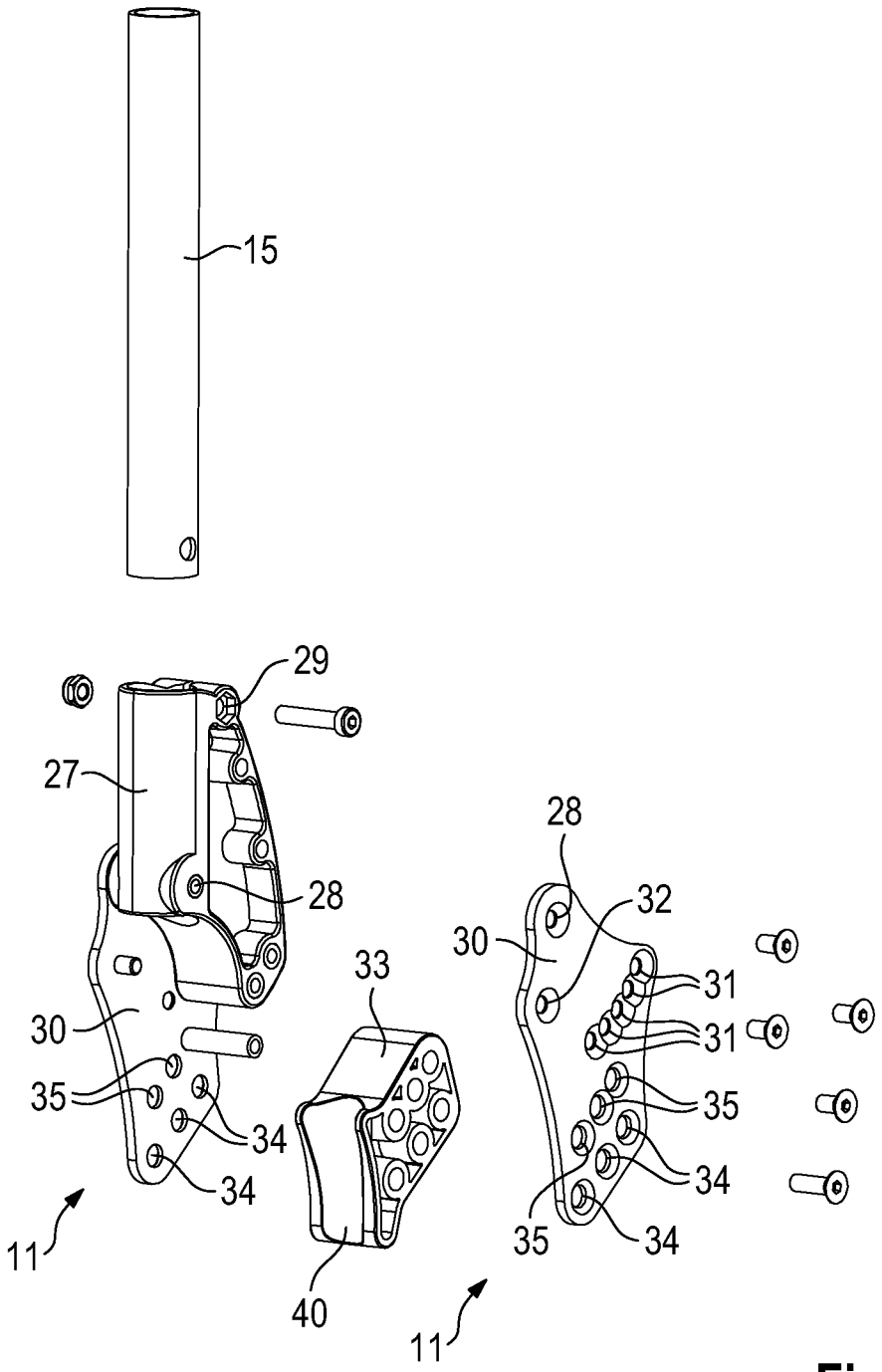
FIG. 6 shows an exploded illustration of details of the wheelchair in the region where a bearing rod or a backrest tube is connected to an adjusting means, which can be connected to a right-hand side frame of the wheelchair.
Figure 9:
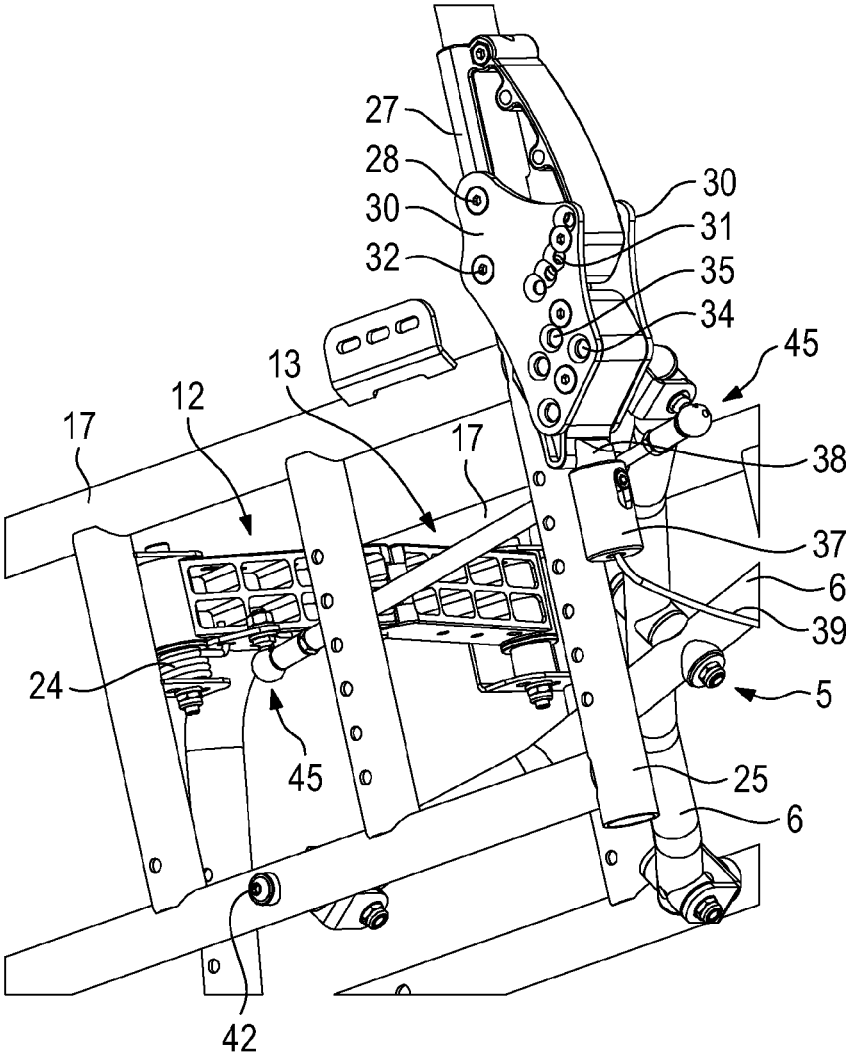
FIG. 9 shows a view seen obliquely from the side of a sub-region of the arrangement according to FIGS. 2 and 3.

At the upper end of the respectively rear, vertically arranged tubes 25 of the side frames 2, the backrest tubes 15 are mounted in a pivotable manner in the regions 26. The design and arrangement of the respective backrest tube 15 which is described hereinbelow is only by way of example and can be realized in a variety of other ways. The backrest tube 15 is guided in a backrest-tube space 27 and is fixed thereto in the region 28 (FIG. 6; FIG. 9). The backrest tube 15 is additionally clamped in a play-free manner in the region 29 (FIG. 6). Two control plates 30 are fixed to the backrest-tube base 27, to the left and right thereof, in the region 28 and of one of the bores 31 (FIG. 6; FIG. 9). In the region of the bores 32 (FIG. 6; FIG. 9) of the control plates 30, the control plates 30 are, and thus the backrest tube 15, is mounted in the tube 25 so as to allow pivoting in the region 26. Between the control plates 30 on the right-hand and left-hand sides of the wheelchair 1, in the lower regions of the control plates, an arresting piece 33 (FIG. 6) is fixed to the control plates 30 in a respective one of the bores 34 and 35 (FIG. 6; FIG. 9). One of the bores 34 here serves, at the same time, as a means for mounting the respective end 10 of the scissor-action element 5 in a rotatable manner by means of a scissor-action end articulation 36. In a manner congruent to the bores 34 and 35 in the control plates 30, the arresting piece 33 likewise has bores, of equal size. The two control plates 30, each arranged on the right-hand and left-hand sides of the wheelchair 1, form a constituent part of the respective, manually actuable adjusting member 11, wherein the adjusting member 11 and/or the control plates 30 are/is actuated manually via the associated backrest tube 15 with pushing handle 16.

A plurality of bores 31 (FIG. 6; FIG. 9) are arranged in circular form around the bore in the region 28, and thus, allow angular adjustment between the backrest-tube base 27 and the control plates 30. This makes it possible to set different backrest angles.

A catch housing 37 is fastened on each respective side frame 2. A catch 38 (FIG. 9) is guided under compression-spring loading in the catch housing 37 and, with the wheelchair 1 in the opened-out state, locks the respective backrest tube 15, via the associated arresting piece 33, to the associated side frame 2. The two catches 38 are connected via a triggering cable 39. By virtue of the triggering cable 39 being actuated, the catches 38 are pulled into the catch housing 37, counter to the spring pressure, and free the pivoting operation of the backrest tubes 15. The operation for arresting the backrest tubes 15 can be realized in a variety of other ways and is provided only by way of example herein. On the side which is directed towards the vertical tube 25, the arresting piece 33 has a hollow-like depression 40 (FIG. 6), and therefore, in the locked state, it establishes a form-fitting connection to the vertical tube 25 and provides the connections between the side frames 2 and the backrest tubes 15 with a high level of strength.

The bores 34 are arranged beneath, and behind, the bore 32, and are thus located behind the vertical tube 25. This ensures that, on the one hand, the rear upper scissor-action end articulations 36 can be mounted in a stable manner, with only a low level of play, in the backrest-tube structures and, on the other hand, the backrest-tube structure can be positioned, and supported, in a form-fitting manner by means of the arresting pieces 33 against the vertical tubes 25.

Figure 7:
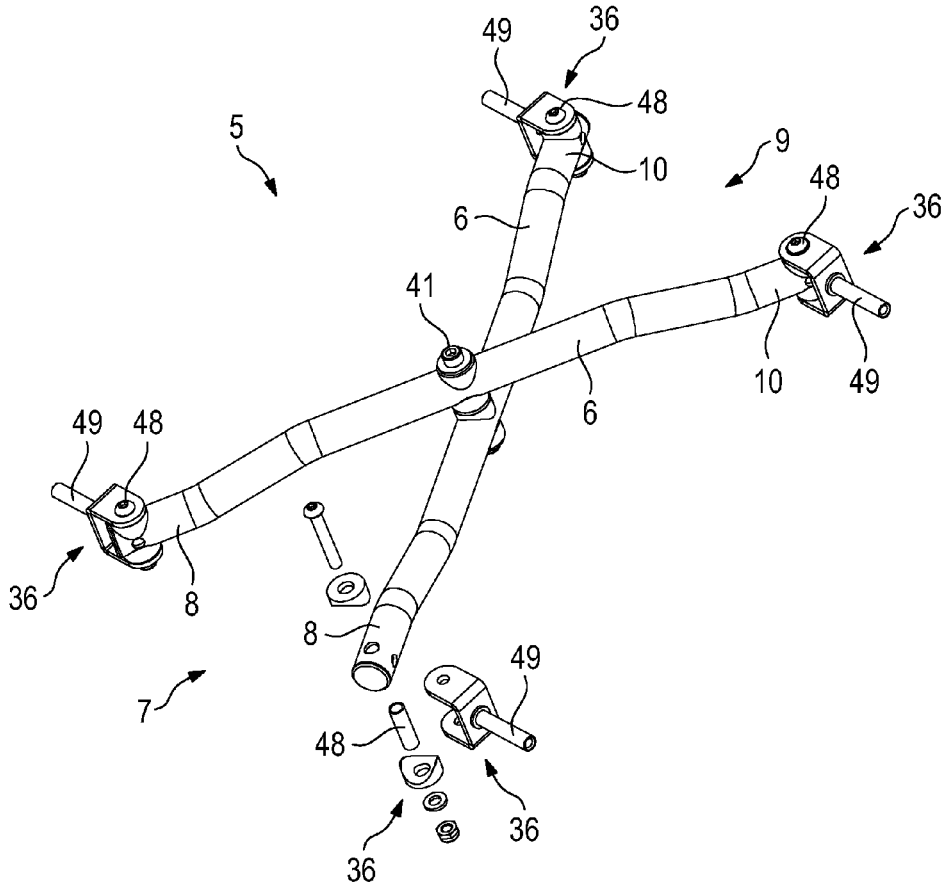
FIG. 7 shows a scissor-action element of the wheelchair, with the elements thereof for connecting to a right-hand side frame and a left-hand side frame of the wheelchair.

As best shown in FIG. 7, the scissor-action element 5 with the two scissor-action arms 6, a central pin 41, which passes through the scissor-action arms 6, and the four scissor-action end articulations 36, is arranged diagonally between the side frames 2. Pins 48, which connect the respective end 8 or 10 of the scissor-action arm 6 to the scissor-action end articulation 36, are arranged parallel to the central pin 41. The scissor-action element 5 has its front, lower scissor-action end articulations 36 mounted in a pivotable manner, by means of pins 49, in bores 42 in the lower, central region of the side frames 2 and has its rear, upper scissor-action end articulations 36 mounted in a pivotable manner, by means of pins 49, in one of the bores 34 of the backrest-tube structures. As far as the respective scissor-action end articulation is concerned, the pins 48 and 49 are arranged perpendicularly to one another. Different positioning of the rear, upper scissor-action end articulation 36 in one of the bores 34, in a manner corresponding to the positioning of the hinge bearing pins 23, generates different seat widths.

Figure 8:
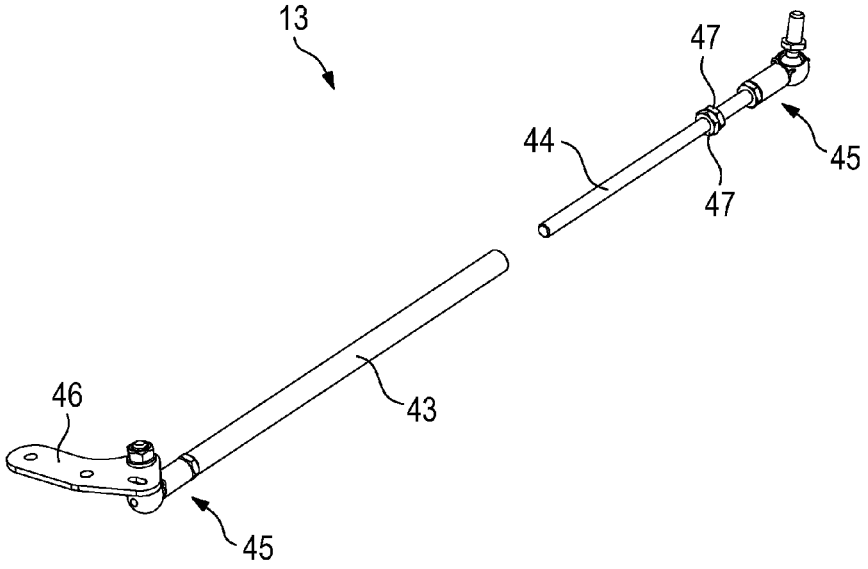
FIG. 8 shows a telescopic adjusting means of the wheelchair, with the connection elements at the ends thereof.

As best shown in FIG. 8, the telescopic adjusting means 13, which is designed in the form of a telescopic connecting-rod linkage, having essentially a cylinder tube 43, a connecting rod 44, two angled articulations 45, a control lever 46 and two adjusting nuts 47 is connected, on the one hand by means of the angled articulation 45 on the connecting rod 44, to one of the rear, upper scissor-action end articulations 36 (in this case on the left as seen in the direction of travel) and, on the other hand by means of the angled articulation 45 on the cylinder tube 43 and the control lever 46, to the corresponding hinge half 20 (likewise located on the left here) of the folding hinge 12.

Figure 10:
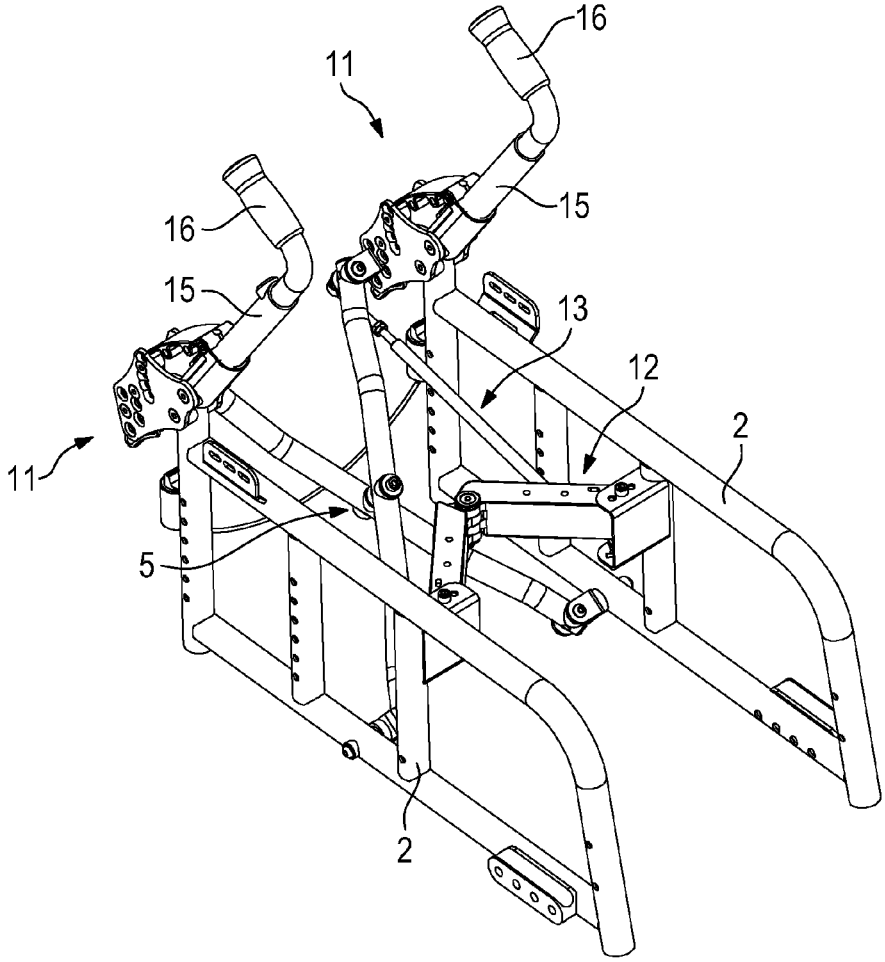
FIG. 10 shows the arrangement according to FIG. 2, but in a folded state which corresponds to the partially folded-together state of the wheelchair.
Figure 11:
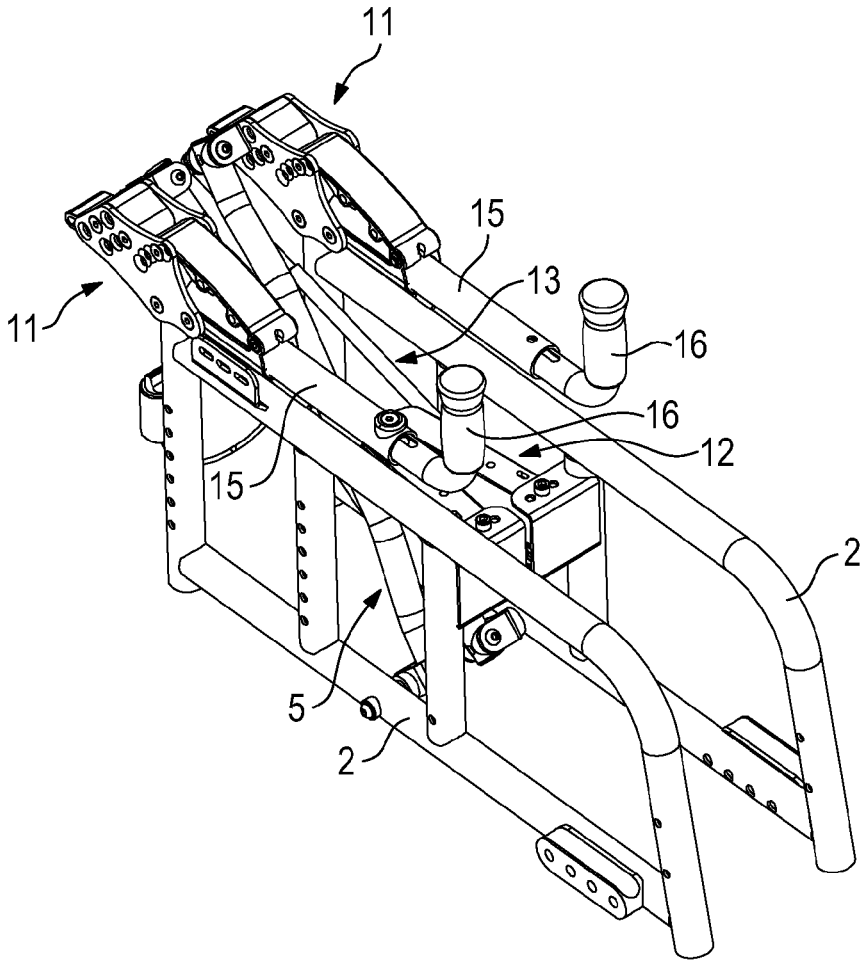
FIG. 11 shows the arrangement according to FIG. 10 in a view like FIG. 10, but depicted for the fully folded-together state.
Figure 12:
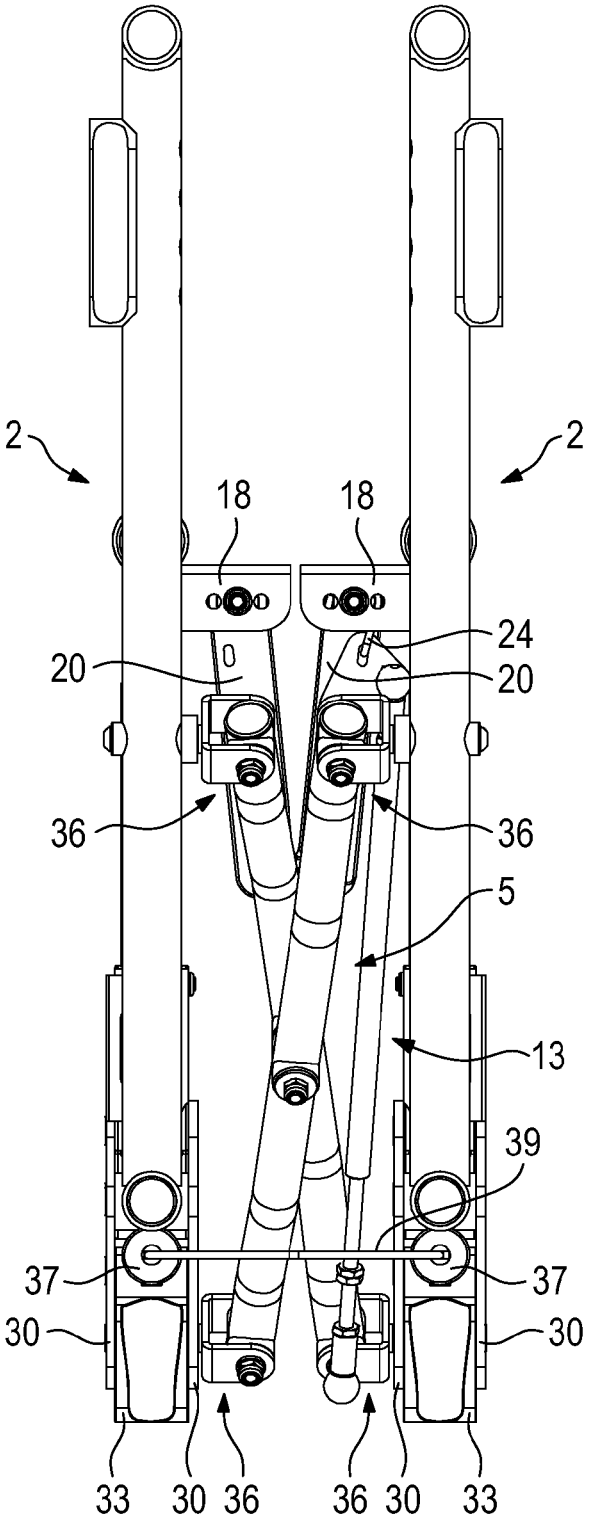
FIG. 12 shows a view from beneath of the arrangement according to FIG. 11, for the fully folded-together state.

FIGS. 10 and 11 show the relevant region of the wheelchair 1 in the partially and fully folded-together positions, respectively.

The possible folding dimensions of the wheelchair 1 are achieved in the manner described hereinbelow. Following actuation of the triggering cable 39, the catches 38 free the arresting pieces 33, and thus the backrest-tube structures. Therefore the backrest tubes 15, for example by the region of the pushing handles 16 being gripped, can be pivoted forwards in the direction of the tubes 17 of the side frames 2. By virtue of this pivoting movement of the backrest tubes 15, and thus also of the control plates 30, that is to say the pivoting movement of the adjusting members 11, the scissor-action element 5, which has the rear, upper scissor-action end articulations 36 mounted in a pivotable manner in the bores 34, is folded together. Since the scissor-action element 5 likewise has the front, lower scissor-action end articulations 36 connected to the side frames 2 in a pivotable manner in the bores 42 in the lower central region of the side frames 2, the side frames 2 are guided towards one another simultaneously. The folding hinge 12, which is subjected to spring force by means of the leg spring 24, is likewise folded together here. The constituent parts of the adjusting means 13 are telescoped apart from one another as a result of the different distances covered by the angled articulations 45 on folding hinge 12 and the one scissor-action end articulation 36.

When the wheelchair 1 is opened out, the backrest tubes 15 are pivoted upwards to the rear until, in the end position, they latch in behind the catches 38 by way of the arresting pieces 33. The adjusting means 13, and therefore the connecting-rod linkage, is retracted to the full extent during the final phase of the pivoting operation, since the cylinder tube 43 comes into contact with the locked adjusting nuts 47 and the connecting-rod linkage guides the folding hinge 12, counter to the spring pressure of the leg spring 24, into the neutral position, that is to say the dead-center position, in which all three points of rotation of the folding hinge 12 are located on a single line. In this position, the folding hinge 12 establishes a very strong connection between the two side frames 2, without subjecting the connecting-rod linkage to any pressure other than that caused by the leg spring 24.

In order for the folding hinge 12 to be guided precisely into the neutral position, the fully retracted length of the adjusting means 13 or the connecting-rod linkage, can be set by means of the two adjusting nuts 47, which can be locked in relation to one another. For this purpose, the connecting rod 44 is provided with an appropriately long thread on its side which is directed towards the angled articulation 45.

The arresting piece 33 and the catch 38 are configured, in the region of their contact surfaces in the locked state, such that they are positioned at an angle of between optimally about ten degrees (10°) and about twenty degrees (20°) to the movement axis of the catches 38. This ensures, on the one hand, that the arresting pieces 33 are forced onto the vertical tube 25 in a play-free manner by the catches 38 and, on the other hand, that the catches 38, when the wheelchair is being pushed, that is to say when the backrest tubes 15 are being subjected to pressure in the forward direction, are not forced downwards by the arresting pieces 33 and accidentally unlock the backrest-tube structure.

The strength of the wheelchair frame is achieved by:

a) the uniform distribution of transverse connections of the two side frames 2, aa) having the rear, upper connections (by means of scissor-action end articulations 36) of the diagonally arranged scissor-action element 5 on the backrest-tube structures in a respective one of the bores 34, ab) having the front, lower connections (by means of scissor-action end articulations 36) of the diagonally arranged scissor-action element 5 on the side frames 2 in a respective one of the bores 42, and ac) having the front, upper connection in the bores 19 of the hinge bearings 18 by way of the neutral-position folding hinge 12, b) the connection between the scissor-action element 5, in one of the rear, upper scissor-action end articulations 36, and the folding hinge 12 by way of the adjusting means 13 or the connecting-rod linkage, and/or c) the form-fitting and play-free contact between the arresting pieces 33 and the vertical tubes 25.

The seat width of the wheelchair frame is adjusted, on the one hand, by virtue of the hinge bearing pins 23 being shifted between the bores 19 of the hinge bearings 18 and, on the other hand, by virtue of the rear, upper scissor-action end articulations 36 of the scissor-action element 5 being shifted between the bores 34. The bores 34 in the control plates 30 and in the arresting pieces 33 are positioned such that the seat width, as in the case of the scissor-action element 5, is adjusted for example by intervals of 2 cm. The present scissor-action element 5 and the present folding hinge 12 can be used to adjust the wheelchair, for example to the seat widths 32 cm, 34 cm and 36 cm.

The bores 35 serve, in an exemplary embodiment, merely for fixing the arresting pieces 33. The next-smaller set of scissor-action element 5 and folding hinge 12 can be used to adjust the wheelchair, for example to the seat widths 28 cm, 30 cm and 32 cm. In this case, the bores 35 serve for attaching the rear, upper scissor-action end articulations 36 and the bores 34 serve for fixing the arresting pieces 33. It is thus possible for the exemplary embodiments described herein to achieve a total of five seat widths.

That which is claimed is:

1. A foldable wheelchair comprising:

two side frames, in each of which a front wheel and a rear wheel are mounted a scissor-action element, which is arranged between the side frames and has two scissor-action arms, the scissor-action arms, in the region of a scissor-action element end, are mounted in a pivotable manner in the side frames, the scissor-action arms, in the region of another scissor-action element end, are mounted in a pivotable manner in manually actuable adjusting members, which are mounted in a pivotable manner in the side frames at a distance from the pivot axis of the another scissor-action element end in the associated adjusting member;

a folding hinge, which is mounted in a pivotable manner in the side frames at a distance from the another scissor-action element end;

an adjusting means, which is connected in a pivotable manner to the folding hinge at a distance from where the folding hinge is mounted in the side frames, the adjusting means being active between the folding hinge and one of the adjusting members, at a distance from the pivot axis of said adjusting member in the associated side frames; and means by way of which at least one adjusting member is secured in an opened-out position of the wheelchair relative to the side frame assigned to said adjusting member.

2. The foldable wheelchair according to claim 1, further comprising a bearing rod for a pushing handle for pushing the wheelchair mounted in each adjusting member.

3. The foldable wheelchair according to claim 2, wherein each bearing rod, when the wheelchair is in the opened-out position, is arranged perpendicularly to the plane in which the front wheels and the rear wheels stand on the ground and, in a folded-together position of the wheelchair, each bearing rod, in the region of an end which accommodates the pushing handle, is arranged adjacent to the associated side frame.

4. The foldable wheelchair according to claim 3, wherein each adjusting member, for the purpose of transferring the wheelchair from the opened-out position into the folded-together position, can be pivoted through an angle of about eighty degrees (80°) to about ninety degrees (90°).

5. The foldable wheelchair according to claim 1, characterized in that the folding hinge can be folded in a plane which is parallel to the plane in which the front wheels and the rear wheels stand on the ground.

6. The foldable wheelchair according to claim 3, wherein the folding hinge, in the folded-together position, is directed towards a rear axle of the wheelchair, said rear axle extending between the rear wheels.

7. The foldable wheelchair according to claim 6, wherein the scissor-action element, in the region of one scissor-action element end, and the folding hinge are connected to the side frames in front of the rear axle and the scissor-action element, in the region of the other scissor-action element end, is mounted in the adjusting members behind the rear axle.

8. The foldable wheelchair according to claim 7, wherein the scissor-action arms, in the region of one scissor-action element end, are mounted in first holders such that they can be pivoted about parallel pins, and these the first holders are mounted in the side frames such that they can be pivoted about a pin, which is arranged perpendicularly to said parallel pins, and the scissor-action arms, in the region of the other scissor-action element end, are mounted in second holders such that they can be pivoted about parallel pins, and these the second holders are mounted in the adjusting members such that they can be pivoted about a pin, which is arranged perpendicularly to said parallel pins.

9. The foldable wheelchair according to claim 8, wherein the scissor-action element, in the region of one scissor-action element end, is mounted in lower regions of the side frames and the adjusting members, which accommodate the scissor-action element in the region of the other scissor-action element end, are mounted in upper regions of the side frames.

10. The foldable wheelchair according to claim 7, wherein the adjusting means, in the region of an end which is directed away from the folding hinge, is mounted in a pivotable manner in one of the adjusting members or is mounted in a pivotable manner in one of the second holders for one of the scissor-action arms, said second holder being mounted in the adjusting member.

11. The foldable wheelchair according to claim 1, wherein the adjusting means is telescopic and has a stop for limiting the contracting movement of the adjusting means when the wheelchair is in the opened-out position.

12. The foldable wheelchair according to claim 1, wherein the folding hinge comprises two hinge parts, and wherein spring means are active between one of the side frames and one of the hinge parts of the folding hinge for the subjecting said hinge part to an adjusting force to move the folding hinge in the direction of the folded-together position.

13. The foldable wheelchair according to claim 12, wherein the folding hinge has bearing pins and a pivot pin between the two hinge parts, and wherein the bearing pins of the folding hinge and the pivot pin of the folding hinge (12), in the opened-out position of the wheelchair, are arranged on a straight line.

14. The foldable wheelchair according to claim 1, wherein the adjusting members are mounted in a pivotable manner in a region of rear ends of the side frames, and wherein first bearing pins of the scissor-action element in a region of the other scissor-action element end are arranged beneath, and behind, second bearing pins of the adjusting members in the side frames.

15. The foldable wheelchair according to claim 1, wherein a position where the folding hinge is mounted in the side frames and a position of bearing points of the scissor-action element end can be altered for the purpose of adjusting a width of the side frames.

* * * * *